US007235515B2

(12) United States Patent
Karkenny

(10) Patent No.: US 7,235,515 B2
(45) Date of Patent: Jun. 26, 2007

(54) METHOD OF MAKING A LUBRICATION ADDITIVE

(76) Inventor: Ibnsina Karkenny, 1473 W. Ruritan Rd., NE., Roanoke, VA (US) 24012

( * ) Notice: Subject to any disclaimer, the term of this patent is extended or adjusted under 35 U.S.C. 154(b) by 518 days.

(21) Appl. No.: 10/777,539

(22) Filed: Feb. 11, 2004

(65) Prior Publication Data

US 2005/0176595 A1 Aug. 11, 2005

(51) Int. Cl.
*A23L 1/32* (2006.01)

(52) U.S. Cl. ..... 508/217; 426/558; 426/614; 426/417; 426/520; 426/478

(58) Field of Classification Search ..... 508/217; 426/614, 417, 520, 478
See application file for complete search history.

(56) References Cited

U.S. PATENT DOCUMENTS

| | | | | |
|---|---|---|---|---|
| 4,219,585 | A * | 8/1980 | Herring | 426/614 |
| 4,828,574 | A | 5/1989 | Bertram | |
| 5,028,449 | A * | 7/1991 | Hatanaka | 426/614 |
| 5,487,838 | A | 1/1996 | Luciani et al. | |
| 6,054,421 | A | 4/2000 | Lyons et al. | |
| 6,281,175 | B1 | 8/2001 | Lyons et al. | |
| 6,391,832 | B2 | 5/2002 | Lyons et al. | |
| 2001/0051595 | A1 | 12/2001 | Lyons et al. | |
| 2003/0000866 | A1 | 1/2003 | Cain | |
| 2003/0139303 | A1 | 7/2003 | Scharf et al. | |

FOREIGN PATENT DOCUMENTS

| | | | |
|---|---|---|---|
| DE | 004200678 | A1 | 1/1992 |
| WO | WO 9103946 | A1 * | 4/1991 |

OTHER PUBLICATIONS

Lewis, Richard J., Hawley's Condensed Chemical Dictionary, 1997, Van Nostrand Reinhold, 13th Ed., pp. 841.*

* cited by examiner

*Primary Examiner*—Anhtuan T. Nguyen
*Assistant Examiner*—Amy T. Lang
(74) *Attorney, Agent, or Firm*—Kelly Lowry & Kelley, LLP

(57) ABSTRACT

A process of making a lubrication additive from an egg having a yolk and egg white includes the step of separating the egg yolk from the egg white. The yolk is heated and a paste is formed from the heated yolk for use as a lubricant or an additive. A lubricating oil may also be formed from the heated yolk for use as a lubricant or an additive.

24 Claims, 1 Drawing Sheet

METHOD OF MAKING A LUBRICATION ADDITIVE

BACKGROUND OF THE INVENTION

The invention relates generally to a lubricating additive. More particularly, the invention relates to a lubricating additive derived from egg yolk.

There is a great need for a lubricating additive that can be applied to a wide range of uses. Over the years, many types of lubricants have been used to aid a user in reducing heat and friction. Other types of lubricants have been added to paints, cosmetics or the like to provide better viscosity, uniformity, heat conductivity or the like. However, such lubricants are often made from synthetic or refined materials and require the use of solvents and complicated procedures during formulation. Even lubricants or oil additives derived from natural ingredients, such as egg yolks, require the use of solvents during preparation. For example, DE 4200678A1 discloses a preparation of egg yolk oil or egg white oil for use in paints, lacquers, cosmetics and wood protectants. However, solvents are used during the preparation process. Solvents are undesirable in that the trace amounts of the solvent may remain in the final product and affect the physical properties of the final product.

While methods of preparing egg yolks for use as a lubricant, such as the one described above, may provide a lubricant for use in a variety of applications, such methods can always be improved to eliminate the use of solvents or the like during formulation.

Accordingly, there is a need for method of making an egg-derived lubricant or additive that eliminates the use of solvents during the process. There is also a need for a simplified method of making an egg-derived lubricant or additive. The present invention satisfies these needs and provides other related advantages.

SUMMARY OF THE INVENTION

The present invention provides a method of making an egg-derived lubricant or additive that eliminates the use of solvents during the process. The present invention further provides a simplified method of making an egg-derived lubricant or additive.

An embodiment of the present invention, in the form of a process for making an lubricating additive from egg(s) having a yolk and egg white. The process starts with separating the egg yolk from the egg white. At least a portion of the yolk is placed in a closed heating vessel which is heated within the range of 325 to 425 degrees Fahrenheit (approximately 160 to 220 degrees Celsius) to evaporate an oil therefrom. The oil can also be evaporated by heating the portion of yolk within the range of 350 to 400 degrees Fahrenheit (approximately 175 to 205 degrees Celsius).

The evaporated oil is condensed and water content removed from the condensed oil to form the lubrication additive. The condensed oil is heated within the range of 212 to 300 degrees Fahrenheit (approximately 100 to 150 degrees Celsius) to remove water content.

The egg yolk is divided into a first portion to make a lubrication paste and a second portion to make the oil. The lubrication paste formed from the first portion is mixed with the oil made from the second portion.

The first portion of the yolk is placed in an open heating vessel and the first portion heated therein within the range of 250 to 375 degrees Fahrenheit (approximately 120 to 195 degrees Celsius).

As noted above, the second portion of yolk is heated in the closed heating vessel within the range of 350 to 400 degrees Fahrenheit (approximately 175 to 205 degrees Celsius).

The first portion of egg yolk is stirred to form the first portion into the lubrication paste. The lubrication paste is also browned by heating and stirring the lubrication paste until the lubrication paste turns a brownish color.

The paste and oil can be formed separately and then mixed together to form a combined lubrication additive or the paste and oil can formed separately as individual lubrication additives.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
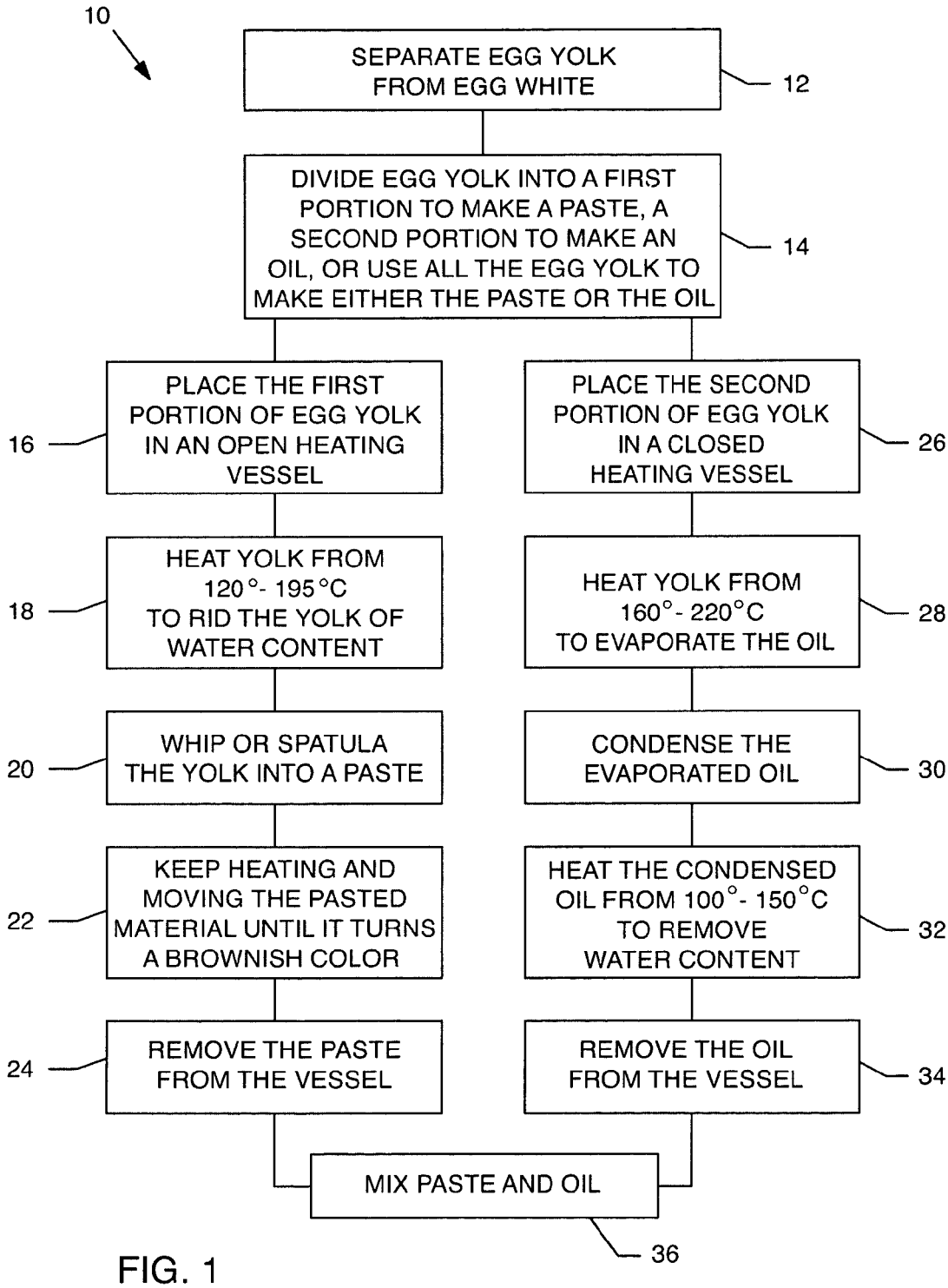
FIG. 1 illustrates a method of making a paste and an oil from egg yolk.

The present invention provides a method of making an egg-derived lubricant or additive that eliminates the use of solvents during the process. The present invention further provides a simplified method of making an egg-derived lubricant or additive.

As shown in the drawings for purposes of illustration, an embodiment of the present invention resides in a method of making a paste and/or an oil for lubrication that is derived from eggs. As illustrated in FIG. 1, the process 10 of making a lubricating additive starts with eggs. An ordinary chicken egg (organic or otherwise) includes a yolk and egg white. A number of eggs may be selected appropriate to the amount of paste and/or oil desired.

The egg yolk can be separated 12 from the egg white using a number of methods. One method involves breaking the egg shell and running the egg across an inclined screen where the egg white runs through the screen while the egg yolk slides toward the bottom of the inclined screen and into a holding apparatus for further processing, but leaves the egg yolk sack. However, hard boiling the egg to a very hard boil allows the user to break open the egg and remove the egg yolk and the egg yolk sack with little to no loss of egg yolk. Also, boiling the egg(s) in a container until the egg(s) are hard-boiled makes it possible to remove the yolk sack more easily; leaving the yolk very pure of starch. The entire yolk is used and the egg white and egg shell may be discarded.

The process includes a first sub-process for forming a paste from the heated yolk and a second sub-process for forming a lubricating oil from the heated yolk. To this end, the yolk is divided 14 into a first portion to make the paste and a second portion to make the lubricating oil. Alternatively, all of the yolk can be used to make the paste or all of the yolk can be used to make the lubricating oil.

During the process of making the paste, the first portion of egg yolk is placed 16 in an open heating vessel as part of the heating process. The yolk is heated 18 from 250 to 375 degrees Fahrenheit (approximately 120 to 195 degrees Celsius), preferably 300 to 350 degrees Fahrenheit (approximately 150 to 175 degrees Celsius), to form the paste. As the yolk is heated, water content is removed from the yolk by heating the yolk at 325 degrees Fahrenheit (approximately 160 degrees Celsius).

When the yolk is completely dry of all moisture content, the heat is increased and a stirring device including, but not limited to a whip, spatula or the like is used to mix 20 the egg yolk to form the paste. The paste is then browned through heating and stirring until the paste turns a dark reddish brown (but not blackened brown) color. The turning of the color is rapid. The mixing exposes the egg yolk to the heating surface of the heating vessel for even heating. The yolk should be mixed rapidly in order to prevent the paste from burning and stirred constantly until the paste achieves the desired color 22. Once the yolk-derived paste is the desired color, the paste is immediately removing the heat (by removing the heating vessel from the heat source) and/or removing the paste from the heating vessel. When properly heated and mixed, the yolk-derived paste will have a powdery consistency. If the egg yolk is burned anytime in the process, an oil will form and the egg yolk will turn black from the residual carbon.

The time of exposure of the yolk to heat is dependent on the amount of yolk-derived paste material being made. For example, one quantity of yolk can be heated at a temperature of approximately 250 degrees Fahrenheit (approximately 120 degrees Celsius) for approximately 3 hours in order to achieve a golden brown color. At this point the paste is still not complete as the material only has a light golden-brown color. When the egg yolk dries and breaks up into an oily powder (due to the water or moisture content being removed), the user takes a flat spatula or whip and breaks the yolk apart and mixes the yolk rapidly while turning the heat up to 375 degrees Fahrenheit (approximately 195 degrees Celsius). After awhile, the yolk achieves throughout the desired dark brown color (but not black) as well as a paste or putty-like consistency. The user then immediately removes 24 the paste material from the heating vessel or turns off the heat and keeps mixing the material until the temperature drops below 300 degrees Fahrenheit (approximately 150 degrees Celsius).

In the alternative, the process of making the paste can be accomplished on an industrial scale by passing the egg yolk across a direct heat of 375 degrees Fahrenheit (approximately 195 degrees Celsius), mixing unfinished material in and out of the heating surface until the process comes to completion.

During the process of making the lubricating oil, the second portion of egg yolk is placed 26 in a closed heating vessel. The yolk is heated 28 within the range of 325 to 425 degrees Fahrenheit (approximately 160 to 220 degrees Celsius), or preferably 350 to 400 degrees Fahrenheit (approximately 175 to 205 degrees Celsius), to form the oil. If the yolk were heated in an open heating vessel, part of the oil would evaporate and re-condense onto cold surfaces. However, in the closed heating vessel, the oil evaporates from the oil as the yolk is heated but the evaporating oil can be sent into a condensing coil and recaptured.

As the yolk is heated in the closed heating vessel, a paste such as the one described above begins to form. However, the heating of this paste over 400 degrees Fahrenheit (approximately 205 degrees Celsius) causes the paste to turn into a carbon byproduct even as substantially all of the oil and water evaporate from the heated yolk. The evaporated oil and water rise in the closed heating vessel and passes through an opening in the heating vessel to a pipe which carries the evaporated oil and water to a condensing unit to capture the evaporated oil and water. In this way it makes no difference if the egg white is removed or not, as the egg white would just be a residue on the bottom of the heating vessel along with the carbon black egg yolk residue.

In the condensing unit, the evaporated oil is condensed 30 or cooled back to a liquid state. This condensed liquid will have water from the yolk mixed with it. It is necessary to remove the water content from the condensed liquid by heating the condensed liquid. The condensed liquid is moved to the heating vessel and heated 32 slowly from 212 to 350 degrees Fahrenheit (approximately 100 to 175 degrees Celsius), or preferably 212 to 300 degrees Fahrenheit (approximately 100 to 150 Celsius), so that there is sufficient heat to evaporate the water but not enough heat to evaporate the oil. Overheating the condensed liquid will carry the yolk-derived oil up with the water vapor. The evaporating oil is volatile and may catch fire. Caution must be taken to avoid exposing the oil vapor to an open flame. Once the water content is removed, the oil is removed 34 from the heating vessel/condenser assembly.

Alternatively, the oil can be obtained without having to evaporate and condense the oil. The egg yolk can be heated in an open vessel and, as the yolk is heated, the oil separates from the bulk material leaving a putty-like carbon material. The oil can then be squeezed from the putty which hardens and turns brittle as the putty cools to room temperature.

At the end of the process, the paste and the lubricating oil are mixed 36. The paste and lubricating oil can be mixed in different ratios for various viscosity requirements. Alternatively, the paste and oil can be made but not combined. For example, the oil can be used in combination with other lubricants without the paste and the paste can be used in combination with other lubricants without the oil.

This yolk-derived additives can then be added to the desired conventional lubricating oil of choice (depending on the application requirements). There are a wide range of applications that this material can be used. The yolk-derived materials may be used in a number of ways including, without limitation, as an additive for lubricants, paints, lacquers, polish, cosmetics, and other oil-based materials. In one application, the yolk-derived paste can be washed with soap and water, dried, and then added to a radiator to improve the release of heat in the radiator.

The yolk-derived paste and yolk-derived oil additives provide noticeable improvements when used including, without limitation, lowered friction, lowered operating temperature, increased gas mileage, cleaner oil, decreased carbon deposits, cleaner burning, and oil stabilization.

Many different factors including, without limitation, viscosity and quantity, are taken into account when using this yolk-derived material in different applications. For example, the paste and oil affect the viscosity of the substance to which the paste and/or oil is added. The oil derived from the egg yolk makes the lubricant to which the oil is added run thinner while the paste derived from the egg yolk gives body to the lubricant to which the paste is added. The amount of paste and/or oil added to a substance depends on the quantities involved. In general, one part oil is derived from the yolk of one large egg and one part oil is derived from the yolk of one large egg. For example, in one formulation, one part yolk-derived oil and one part yolk-derived paste were added to 4 to 5 quarts of a conventional oil. For larger quantities of conventional oil, a user needs to add proportional amounts of yolk-derived oil and/or yolk-derived paste.

In situations where purity is not an issue, the paste may be prepared by separating the egg yolk and egg white without removing the egg yolk sack. Once the paste is made using the steps outlined above, and added to the desired lubricant or other material, the lubricant or other material can be passed through a filter and the contaminant (i.e., egg yolk sack) can be removed.

The above-described embodiments of the present invention are illustrative only and not limiting. It will thus be apparent to those skilled in the art that various changes and modifications may be made without departing from this invention in its broader aspects. Therefore, the appended claims encompass all such changes and modifications as falling within the true spirit and scope of this invention.

What is claimed is:

1. A process for making a lubrication additive from an egg having a yolk and an egg white, comprising the steps of:

separating the yolk from the egg white;

dividing the yolk into a portion and a second portion;

placing the second portion of the yolk in a closed heating vessel;

heating the second portion of the yolk in the closed heating vessel within the range of 160 to 220 degrees Celsius to evaporate an oil therefrom;

condensing the evaporated oil;

removing water content from the condensed oil;

heating the first portion of the yolk to form a lubrication paste; and mixing the lubrication paste formed from the first portion with the condensed oil made from the second portion.

2. The process of claim 1, wherein the evaporating step includes the step of heating the yolk within the range of 175 to 205 degrees Celsius.

3. The process of claim 1, wherein the step of removing water content from the condensed oil includes the step of heating the condensed oil within the range of 100 to 150 degrees Celsius.

4. The process of claim 1, including the steps of placing the first portion of the yolk in an open heating vessel, and heating the first portion of the yolk therein within the range of 120 to 195 degrees Celsius.

5. The process of claim 4, wherein the step of heating the portion of yolk in the closed heating vessel includes the step of heating the yolk within the range of 175 to 205 degrees Celsius.

6. The process of claim 4, wherein the lubrication paste forming step includes the step of stirring the first portion of egg yolk to form it into the lubrication paste.

7. The process of claim 6, including the step of browning the lubrication paste.

8. The process of claim 7, wherein the browning step includes the step of eating and stirring the lubrication paste until it turns a brownish color.

9. A process for making a lubrication additive from an egg having a yolk and an egg white, comprising the steps of:

separating the yolk from the egg white;

dividing the yolk into a first portion and a second portion;

placing the first portion of the yolk in an open heating vessel;

heating the first portion of yolk within the range of 120 to 195 degrees Celsius;

forming a lubrication paste from the heated yolk; and placing the second portion of the yolk in a closed healing vessel to form a lubrication oil.

10. The process of claim 9, including the steps of heating the second portion of yolk within the range of 160 to 220 degrees Celsius to evaporate the oil, and then condensing the evaporated oil.

11. The process of claim 10, wherein the step of heating the second portion of the yolk includes the step of heating it within the range of 175 to 205 degrees Celsius to form the oil.

12. The process of claim 10, including the steps of heating the condensed oil to within the range of 100 to 150 degrees Celsius to remove water content.

13. The process of claim 12, including the step of removing the condensed oil from the closed heating vessel.

14. The process of claim 12, including the step of mixing the paste and the condensed oil.

15. The process of claim 14, wherein the paste forming step includes the step of stirring the egg yolk to form it into the paste.

16. The process of claim 14, wherein the step of heating the second portion of the yolk includes the step of heating the yolk within the range of 175 to 205 degrees Celsius to evaporate the oil.

17. A process for making a lubrication additive from an egg having a yolk and an egg white, comprising the steps of:

separating the yolk from the egg white;

dividing the yolk into a first portion to make a lubrication paste and a second portion to make a lubrication oil;

placing the first portion of the yolk in an open heating vessel;

placing the second portion of the yolk in a closed heating vessel;

heating the second portion of the yolk within the range of 160 to 220 degrees Celsius to evaporate a lubricating oil therefrom;

heating the first portion of the yolk within the range of 120 to 195 degrees Celsius;

forming a lubrication paste from the first portion of heated yolk;

browning the lubrication paste to form a first lubrication additive;

condensing the evaporated oil;

removing water content from the condensed oil to form a second lubrication additive; and mixing the first and second lubrication additives.

18. The process of claim 17, wherein the evaporating step includes the step of heating the second portion of the yolk within the range of 175 to 205 degrees Celsius.

19. The process of claim 17, wherein the step of removing water content from the condensed oil includes the step of heating the condensed oil within the range of 100 to 150 degrees Celsius.

20. The process of claim 17, wherein the step of heating the second portion of yolk includes the step of heating the yolk within the range of 175 to 205 degrees Celsius.

21. The process of claim 17, wherein the lubrication paste forming step includes the step of stirring the first portion of egg yolk to form it into the lubrication paste.

22. The process of claim 17, wherein the browning step includes the step of heating and stirring the lubrication paste until it turns a brownish color.

23. The process of claim 17, wherein the water content removing step includes the step of heating the condensed oil to within the range of 100 to 150 degrees Celsius.

24. The process of claim 17, including the steps of removing the second lubrication additive from the closed heating vessel; and removing the first lubrication additive from the open heating vessel.

* * * * *